US007128443B2

(12) United States Patent
Marra et al.

(10) Patent No.: US 7,128,443 B2
(45) Date of Patent: Oct. 31, 2006

(54) LIGHT-COLLIMATING SYSTEM

(75) Inventors: Johannes Marra, Eindhoven (NL); Harald Glaeser, Freiburg (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 126 days.

(21) Appl. No.: 10/518,830

(22) PCT Filed: Jun. 13, 2003

(86) PCT No.: PCT/IB03/02868

§ 371 (c)(1),
(2), (4) Date: Dec. 21, 2004

(87) PCT Pub. No.: WO2004/003603

PCT Pub. Date: Jan. 8, 2004

(65) Prior Publication Data

US 2005/0237744 A1 Oct. 27, 2005

(30) Foreign Application Priority Data

Jun. 28, 2002 (EP) ..... 02077560

(51) Int. Cl.
*F21V 14/04* (2006.01)
*F21V 11/04* (2006.01)
*F21V 17/02* (2006.01)

(52) U.S. Cl. ..... 362/279; 362/283; 362/284; 362/324; 362/325; 362/342

(58) Field of Classification Search ..... 362/279, 362/283, 325, 342
See application file for complete search history.

(56) References Cited

U.S. PATENT DOCUMENTS

| | | | | | |
|---|---|---|---|---|---|
| 1,326,393 | A | * | 12/1919 | D'Humy | 362/283 |
| 1,413,439 | A | * | 4/1922 | Wempner | 362/283 |
| 2,321,008 | A | * | 6/1943 | Cantor | 362/283 |
| 2,387,816 | A | | 10/1945 | Wagner | |
| 4,602,321 | A | * | 7/1986 | Bornhorst | 362/324 |
| 5,003,445 | A | * | 3/1991 | Burn et al. | 362/284 |
| 6,076,943 | A | * | 6/2000 | Lassovsky | 362/283 |

FOREIGN PATENT DOCUMENTS

| | | | | |
|---|---|---|---|---|
| WO | WO 9012245 A1 | * | 10/1990 | 362/290 |
| WO | WO9736131 A1 | | 10/1997 | |

* cited by examiner

*Primary Examiner*—Alan Cariaso

(57) ABSTRACT

A light-collimating system for collimating light from a light source has a plurality of elements (2, 2', . . . ), each element including at least a first wall (3, 3', . . . ) and at least a second wall (4, 4', . . . ). The first (3) and second wall (4') of adjacent elements are spaced with respect to each other at a side of the light-collimating system facing the light source, the spacing defining an aperture window (5, 5', . . . ) for admitting light into the light-collimating system. The first and second wall of said adjacent elements form a wedge-shaped structure widening in a direction facing away from the light source. The first and the second wall are provided with a specular reflecting surface at a side facing the wedge-shaped structure. According to the invention, the wedge angle (w of the first and second wall with respect to the normal on the aperture window are adjustable for enabling adjustable collimation.

15 Claims, 4 Drawing Sheets

LIGHT-COLLIMATING SYSTEM

The invention relates to a light-collimating system for collimating light.

Such light-collimating systems are known per se. They are used inter alia as backlight-collimating systems in (picture) display devices, for example for TV sets and monitors. Such light-collimating systems are particularly suitable for use as backlights for non-emissive displays such as liquid crystal display devices, also denoted LCD panels, which are used in (portable) computers, TV sets or (portable) telephones.

Said display devices usually comprise a substrate provided with a regular pattern of pixels which are each controlled by at least one electrode. The display device utilizes a control circuit for achieving a picture or a data graphical display in a relevant field of a (picture) screen of the (picture) display device. The light originating from the backlight in an LCD device is modulated by means of a switch or modulator, various types of liquid crystal effects being used. In addition, the display may be based on electrophoretic or electromechanical effects.

Such light-collimating systems are also used as luminaires for general lighting purposes or for shop lighting, for example shop window lighting or the lighting of (transparent or semi-transparent) plates of glass or of synthetic resin on which items, for example jewelry, are displayed. Such light-collimating systems are further used as window panes, for example for causing a glass wall to radiate light under certain conditions, or to reduce or block out the view through the window by means of light. Further alternative applications are the use of such light-collimating systems for illuminating advertising boards, drawing tables and X-Ray photographs.

In the light-collimating systems mentioned in the opening paragraph, the light source used is usually a tubular low-pressure mercury vapor discharge lamp, for example one or a plurality of cold-cathode fluorescent lamps (CCFL), wherein the light emitted by the light source during operation is coupled into the light-emitting panel, which acts as an optical waveguide. This waveguide usually constitutes a comparatively thin and planar panel which is manufactured, for example, from synthetic resin or glass, and in which light is transported through the optical waveguide under the influence of (total) internal reflection.

As an alternative light source, such a light-collimating system may also be provided with a plurality of optoelectronic elements, also referred to as electro-optical elements, for example electroluminescent elements, for example light-emitting diodes (LEDs). These light sources are usually provided in the vicinity of or tangent to a light-transmitting edge surface of the light-emitting panel, in which case light originating from the light source is incident on the light-transmitting edge surface during operation and distributes itself in the panel.

Light-collimating systems are preferably embodied as direct-lit backlight-collimating systems when high emitted light intensities are desired and/or when large-area light-emitting surfaces have to be provided. Such a direct-lit backlight-collimating system is known from WO-A 97/36 131. The known backlight-collimating system comprises at least one light source, and a light-directing assembly in close proximity to the light source, the light-directing assembly comprising so-called micro prisms and blocking means between the micro prisms, the blocking means locally blocking the passage of light. In the known light-collimating system the light-blocking means are reflective elements while a reflector is positioned behind and/or around the light source, that is, in the direction away from the light-directing assembly, to redirect light rays propagating away from the light-directing assembly back towards the micro prisms. Employing specular and diffusely reflecting materials, this preferred embodiment increases the total available light output and efficiency of the backlight-collimation system. A drawback of the known light-collimating system is that the light-collimating system has a fixed collimation angle.

It is an object of the invention to eliminate the above disadvantage wholly or partly. To meet the object of the invention, the light-collimating system includes:

a plurality of elements, each element including at least a first wall and at least a second wall, the first wall of an element and the second wall of an adjacent element being spaced with respect to each other at a side of the light-collimating system facing the light source, said spacing between said first wall and said second wall defining an aperture window for admitting light from the light source into the light-collimating system, the first wall of said element and the second wall of said adjacent element forming a wedge-shaped structure widening in a direction facing away from the light source, the first wall and the second wall at a side facing the wedge-shaped structure being provided with a specular reflecting surface, the wedge angle $\theta_w$ of the first wall and the second wall with respect to the normal on the aperture window being adjustable for enabling adjustable collimation.

In the light-collimating system according to the invention, light collimation results from specular reflections from the walls of the wedge-shaped structures. In the known light-collimating system collimation of light is brought about by the total internal reflection (TIR) of incident light from the optically smooth walls of the micro prisms.

In the light-collimating system according to the invention, the wedge-shaped structures are open, hollow structures (filled with air, refractive index n=1). Depending on the design of the wedge-shaped structures, successive reflections may occur in the wedge-shaped structure, which is advantageous for obtaining a large aperture of the light-collimating system. Preferably, the first and second walls are made from a sheet material. Such sheets can easily be drawn into the desired shape, for instance, by a thermal deep-drawing process. In the known light-collimating systems, the wedge-shaped micro prism structures are made from a solid transparent material. The micro prisms in the known light-collimating system have a refractive index which corresponds to the refractive index of the material from which the prisms have been made (generally the refractive index is $n \approx 1.5$).

According to the invention the wedge angle $\theta_w$ of the first wall and the second wall is adjustable. The shape of the wedge-shaped structures is changed when the wedge angle is changed. By adapting the shape of the wedge-shaped structures, the propagation direction of reflected light from the first and/or the second wall changes thereby influencing the way in which light is collimated by the wedge-shaped structures. The light issuing from the light-collimating system according to the invention accordingly has an adjustable degree of collimation.

In the description of this invention, the hollow wedge-shaped structure is also addressed as a (hollow) wedge collimator.

A preferred embodiment of the light-collimating system according to the invention is characterized in that an adjustable positioning plate supports the first wall and the second wall at a side facing away from the wedge-shaped structure, by moving the positioning plate in a direction away from the aperture window the wedge angle $\theta_w$ becoming smaller, and vice versa. By moving the adjustable positioning plate "up" and "down" with respect to the aperture window the wedge angle $\theta_w$, of the first wall and the second wall with respect to the normal on the aperture window becomes smaller and larger, respectively. In this manner adjustable collimation of the light-collimating system according to the invention is realized. The movement of the adjustable positioning plate can for instance be done by the user of the light-collimating system either by mechanical means or by remotely-controlled electro-mechanical means.

Preferably, the wedge angle $\theta_w$ ranges between approximately 0° and approximately 25°. When the wedge angle $\theta_w \approx 0°$ the adjustable positioning plate is in the highest position (remote from the aperture window), whereas when the wedge angle $\theta_w \approx 25°$ the adjustable positioning plate is in the lowest position (close to the aperture window). When the wedge angle is large, the collimation angle $\theta_c$ is small, i.e. a relatively narrow beam of light is issued by the light-collimating system. Preferably, the wedge angle $\theta_w$ ranges between approximately 0° and approximately 15°.

A preferred embodiment of the light-collimating system according to the invention is characterized in that the wedge-shaped structure is configured from a plurality of walls forming a diaphragm-like wedge-shaped structure. The plurality of walls, comprising at least one first wall and at least one second wall, function as (reflective) side flaps of the diaphragm-like wedge-shaped structure. The plurality of first and second walls slide past each other when the wedge angle $\theta_w$, of the walls is changed.

A preferred embodiment of the light-collimating system according to the invention is characterized in that the first wall and the second wall are straight walls. The resulting so-called cone-shaped open wedge-shaped structure is relatively easy to manufacture.

An alternatively preferred embodiment of the light-collimating system according to the invention is characterized in that the first wall and the second wall are curved, preferably, parabolically-shaped walls. A curved or parabolically-shaped wedge is more difficult to manufacture, but is optically more efficient since it allows a certain degree of light collimation to be attained at a larger aperture at no more than only a single specular reflection from the parabolically-shaped walls.

A preferred embodiment of the light-collimating system according to the invention is characterized in that the first wall and the second wall of each element are provided on a supporting member at a side facing away from the light source, and that the supporting member between the first wall and the second wall of each element is provided with a light-reflecting element comprising a specular and/or diffuse reflecting material. Light produced inside the backlight-collimating system is allowed to escape from the light-collimating system only through the aperture-window between the first wall of an element and a second wall of an adjacent element, i.e. at the location of the wedge-shaped structures. Light is not allowed to be transmitted into the cavity between the first and second wall of an element By providing a reflective element between the first and second wall of an element, light is effectively and efficiently back-reflected and subsequently recycled in the backlight-collimating system.

Reflective layers and/or coatings are usually present in any application involving efficient light recycling, light (re)distribution, light transport, and light collimation. Imposed demands on the reflective materials comprise the absence of light absorption within the visible wavelength region, the absence of absorption-induced colour shifts, a high resistance to chemical degradation under the (combined) influence of heat, light, humidity, and an availability at low cost while being easy to process/manufacture. Suitably performing reflective layers are layers of dry binder-free inorganic powder particles. Preferably, the specular reflecting material is selected from the group formed by aluminum and silver and the diffuse reflecting material is selected from the group formed by aluminum oxide, barium sulfate, calcium-pyrophosphate, titanium oxide and yttrium borate. Preferably, the first and second wall of the elements are specularly reflecting, for instance by making the wall of a specularly reflecting material, e.g. aluminum or silver, or by coating the wall with an aluminum or silver layer. The other materials very efficiently contribute to light recycling in (back) light-collimating systems. Preferably, the diffuse reflecting powder material is mixed with particles of Alon-C powder (a gamma-structure aluminum oxide powder (Degussa) possessing an average primary particle size of approximately 20 nm). When calcium-pyrophosphate powder, possessing an average particle diameter of at least 5 μm, is mixed with 1% w/w Alon-C powder, the resulting powder mixture behaves like a so-called free-flowing powder.

A preferred embodiment of the light-collimating system according to the invention is characterized in that the first wall and the second wall are made from glass, metal or plastic. Preferably, the open wedge structure can be created by e.g. a thermal deep-drawing process of an optically smooth aluminum sheet or a plastic PET sheet that is coated with an aluminum or silver layer. The aluminum sheet or layer functions as the specular reflecting surface. The aperture windows, i.e. the space, at the location of the supporting member, between the first wall of an element and a second wall of an adjacent element remain transparent for light. The aperture windows are preferably embodied as windows consisting of a transparent plastic or glass layer that is attached to the supporting member and that connects to the said first wall and second wall at the location of the supporting member thereby maintaining a fixed width of the aperture window.

A preferred embodiment of the light-collimating system according to the invention is characterized in that, at the location of the first and second wall facing the light source, e.g. at the location of the supporting member, the distance $d_{sp}$ between the first wall and the second wall of each element is larger than the wavelength of visible light. By selecting the distance $d_{sp}$ substantially larger than approximately 500 nm, preferably <characterizing portion of claim 12> $d_{sp} \geqq 10$ μm, light diffraction phenomena in and around the wedge structures are avoided, thereby enabling that a diffraction-induced disturbance of the collimation performance of the wedge collimator structure does not occur.

A preferred embodiment of the light-collimating system according to the invention is characterized in that <characterizing portion of claim 13> the height $h_w$ of the wedge-shaped structures is in the range $0.5 \times d_{aw} \leqq h_w \leqq 50 \times d_{aw}$, where $d_{aw}$ is the distance between the first wall of an element and the second wall of an adjacent element at the location of the first and second wall facing the light source. If a supporting member is provided in the light-collimating system, $d_{aw}$ is the distance between the first wall and the second wall at the location of the supporting member. With a height hw in the given range isotropic light emitted by the light source inside the light-collimating system can be collimated to a collimation angle $\theta_c$ within the range $10° \leqq \theta_c \leqq 90°$.

A preferred embodiment of the light-collimating system according to the invention is characterized in that the light-collimating system further comprises a lens assembly, comprising a plurality of lenses, each lens cooperating with one of the wedge-shaped structures. The obtained degree of collimation is further enhanced through the presence of an optional lens assembly on the light-emitting side of the wedge collimator.

A particularly simple light-collimating system is obtained through the measures according to the invention. The light issuing from the light-collimating system according to the invention has an adjustable degree of collimation.

The invention will now be explained in more detail with reference to a number of embodiments and a drawing, in which.

Figure 4:
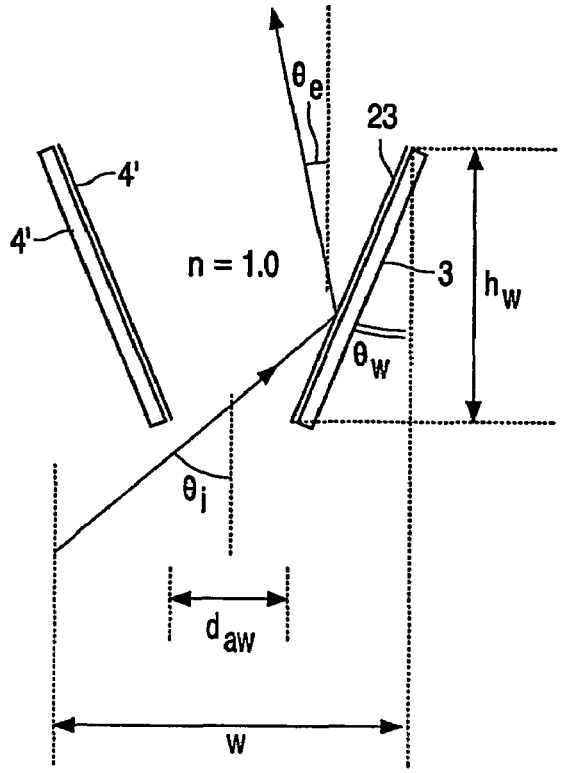
Figure 5:
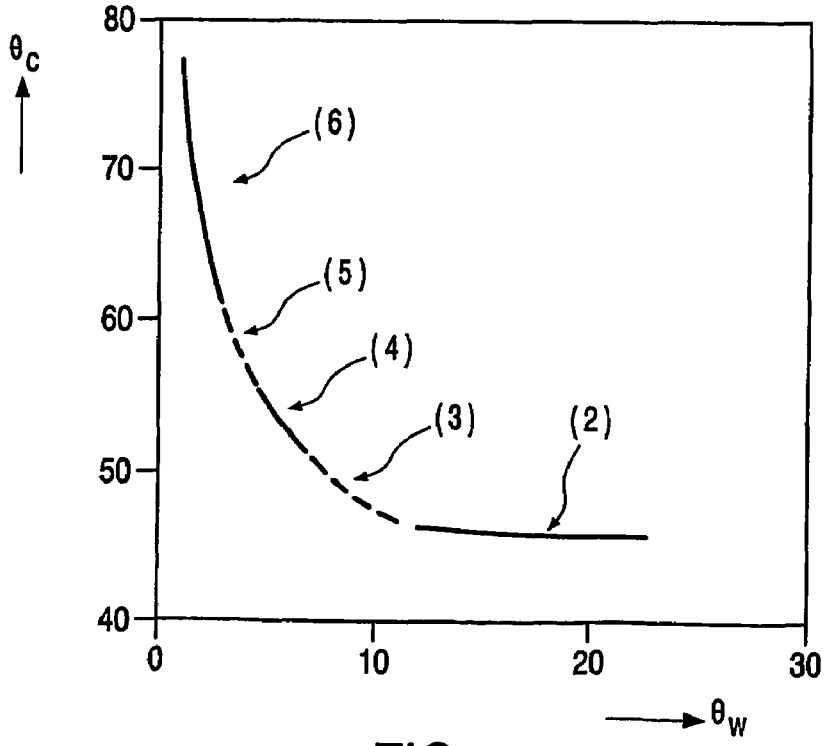

FIG. 4 shows a path of a light ray through a detail of the adjustable wedge collimator, and FIG. 5 shows the collimation angle $\theta_c$ as a function of the wedge angle $\theta_w$ for the adjustable wedge collimator The Figures are purely diagrammatic and not drawn true to scale. Some dimensions are particularly strongly exaggerated for reasons of clarity. Equivalent components have been given the same reference numerals as much as possible in the Figures.

Figure 1:
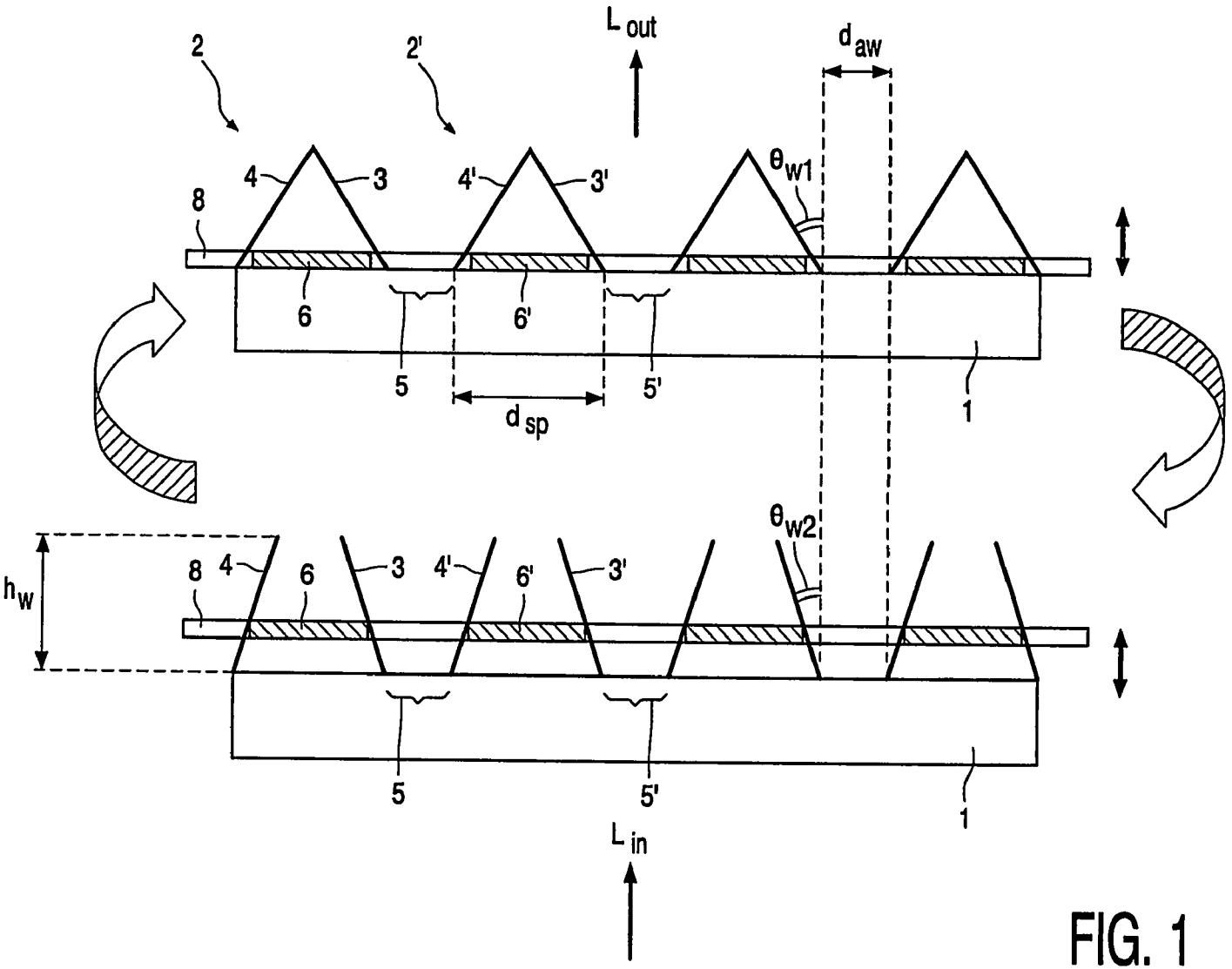
FIG. 1 is a cross-sectional view of an embodiment of the adjustable wedge collimator according to the invention for two different positions of the adjustable positioning plate.

FIG. 1 schematically shows a cross-sectional view of an embodiment of the adjustable wedge collimator according to the invention for two different positions of the adjustable positioning plate 8. The light-collimating system of FIG. 1 comprises a supporting member 1 for admitting light from a light source (not shown in FIGS. 1A and 1B; the direction of the incident light is indicated by the arrow $L_{in}$) into the light-collimating system. The supporting member 1 is provided at a side facing away from the light source with a plurality of elements 2, 2', . . . Each element 2, 2', . . . includes at least a first wall 3, 3', . . . and at least a second wall 4, 4', . . . Preferably, the first wall 3, 3', . . . and the second wall 4, 4', . . . are made from glass, metal or plastic. The first wall 3 of an element 2 and the second wall 4' of an adjacent element 2' is spaced with respect to each other at a side of the light-collimating system facing the light source (in the example of FIG. 1 at the location of the supporting member 1). The spacing between the first wall 3 and said second wall 4' defines an aperture window 5, 5', ... for admitting light from the light source into the light-collimating system. The distance between the first wall 3 and the second wall 4' at the location of the aperture window is also referred to as the aperture width $d_{aw}$. The first wall 3 of the element with reference numeral 2 and the second wall 4' of the adjacent element 2' form a wedge-shaped structure widening in a direction facing away from the light source. In addition, both the first wall 3, 3', . . . and the second wall 4, 4', . . . at a side facing the wedge-shaped structure are provided with a specular reflecting surface (see FIG. 4), preferably made from silver or aluminum. An adjustable positioning plate 8 supports the first wall 3, 3', . . . and the second wall 4, 4', . . . at a side facing away from the wedge-shaped structure. According to the invention, this positioning plate 8 can be moved up and down in a direction away from and towards the aperture window 5, 5', . . . Depending on the position of the positioning plate 8 with respect to the aperture window 5, 5', . . . , the wedge angle $\theta_w$ becomes smaller or larger. In this manner the collimation provided by the light-collimating system becomes adjustable. In an alternative embodiment a lens assembly comprising a plurality of lenses is provided on top of the first wall 3, 3', . . . and the second wall 4, 4',. . . (not shown in FIG. 1). In the example of FIG. 1, the first wall 3, 3', . . . and the second wall 4, 4', . . . are straight walls. In an alternative embodiment, the first wall and the second wall are curved walls, preferably, parabolically-shaped walls (not shown).

In the upper part of FIG. 1 the adjustable positioning plate 8 is in its lowest position. The first wall 3, 3', . . . and the second wall 4, 4', . . . touch each other at the side facing away from the aperture window 5, 5', . . . In this position, the wedge angle $\theta_{w1}$ reaches its largest value. A very suitable value for wedge angle $\theta_{w1} \approx 25°$. Particularly preferred is wedge angle $\theta_{w1} \approx 15°$. In the lower part of FIG. 1 the adjustable positioning plate 8 is shifter away from the aperture window 5, 5', . . . , reaching a higher position. The first wall 3, 3', . . . and the second wall 4, 4', . . . no longer touch each other at the side facing away from the aperture window 5, 5', . . . and the wedge angle $\theta_{w2}$ diminishes. The minimum value for the wedge angle $\theta_{w2} \approx 0°$. When the wedge angle $\theta_w$ is large, the collimation angle $\theta_c$ is small, i.e. a relatively narrow beam of light is issued by the light-collimating system The broad arrows at the side of the two different positions of the adjustable positioning plate 8 in FIG. 1 indicate that the variability of the light-collimating system enables a adjustable collimation angle. Preferably, the light-reflecting element 6, 6', . . . of the adjustable positioning plate 8 facing the aperture window 5, 5', . . . is provided with a light-reflecting element. This light-reflecting element 6, 6', . . . reflects the light efficiently back and this back-reflected light is subsequently recycled in the backlight-collimating system.

Figure 2A:
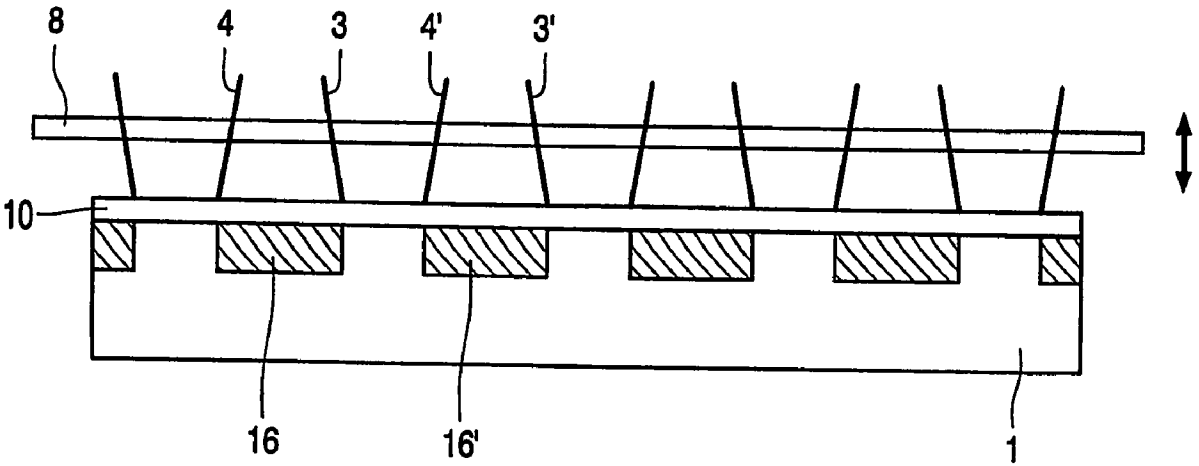
FIG. 2A is a cross-sectional view of an alternative embodiment of the adjustable wedge collimator according to the invention.
Figure 2B:
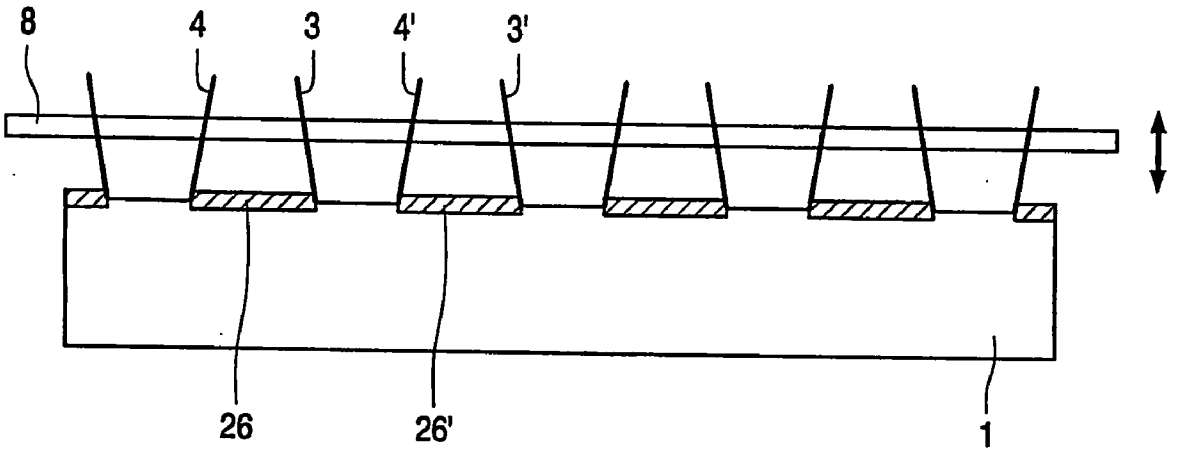
FIG. 2B is a cross-sectional view of a further alternative embodiment of the adjustable wedge collimator according to the invention.

FIG. 2A shows a cross-sectional view of an alternative embodiment of the adjustable wedge collimator. In this embodiment the supporting member 1 between the first wall 3, 3', . . . and the second wall 4, 4', . . . of each element 2, 2', . . . is provided with a light-reflecting element 16; 16', . . . comprising a specular and/or diffuse reflecting material. In the example of FIG. 2A the light-reflecting element 16; 16', . . . is embedded in the supporting member 1, e.g. in tunnels. The FIG. 2B shows a cross-sectional view of a further alternative embodiment of the adjustable wedge collimator. In this embodiment the supporting member 1 between the first wall 3, 3', . . . and the second wall 4, 4', . . . of each element 2, 2', . . . is provided with a light-reflecting element 26; 26', . . . in the form of a coating comprising a specular and/or diffuse reflecting material.

The specular or diffuse reflecting material of the light-reflecting element 6; 6', . . . ; 16, 16', . . . ; 26, 26', . . . preferably comprises a powder material, the material selected from the group formed by aluminum oxide, barium sulfate, calcium-pyrophosphate, titanium oxide and yttrium borate. Use of Ca-pyrophosphate with an average particle diameter between 8 and 10 μm is particularly recommended because of its ready availability, cheapness, chemical purity, resistance to high temperatures (>1000° C.), and its proven non-absorbing characteristics towards visible light within the λ=400–800 nm range after annealing at 900° C. in air. When Ca-pyrophosphate is mixed with 1% w/w Alon-C nano-particles, the resulting powder mixture behaves like a so-called free-flowing powder with which the said tunnels in FIG. 2A can be readily filled to form the reflective elements 16, 16', . . .

At the location of the aperture window 5, 5', . . . , the distance $d_{sp}$ between the first wall 3, 3', . . . and the second wall 4, 4', . . . of each element 2, 2', . . . is preferably larger than the wavelength of visible light. Preferably, both the distances $d_{sp}$ and $d_{aw}$ are larger than 10 μm. Preferably, the distance $d_{sp}$ is larger than 1 mm. The latter makes the filling of the spaces between the first wall 3, 3', . . . and the second wall 4, 4', . . . with the particles of dry, binder-free free-flowing inorganic powder relatively simple. Preferably, the height $h_w$ of the wedge-shaped structures is in the range $0.5\times d_{aw} \leqq h_w \leqq 50\times d_{aw}$, where $d_{aw}$ is the distance between the first wall 3 of an element 2 and the second wall 4' of an adjacent element 2 at the location of the supporting member 1. According to the invention, the light issuing from the light-collimating system (indicated by the arrow $L_{out}$ in FIGS. 1A and 1B) is collimated.

Figure 3:
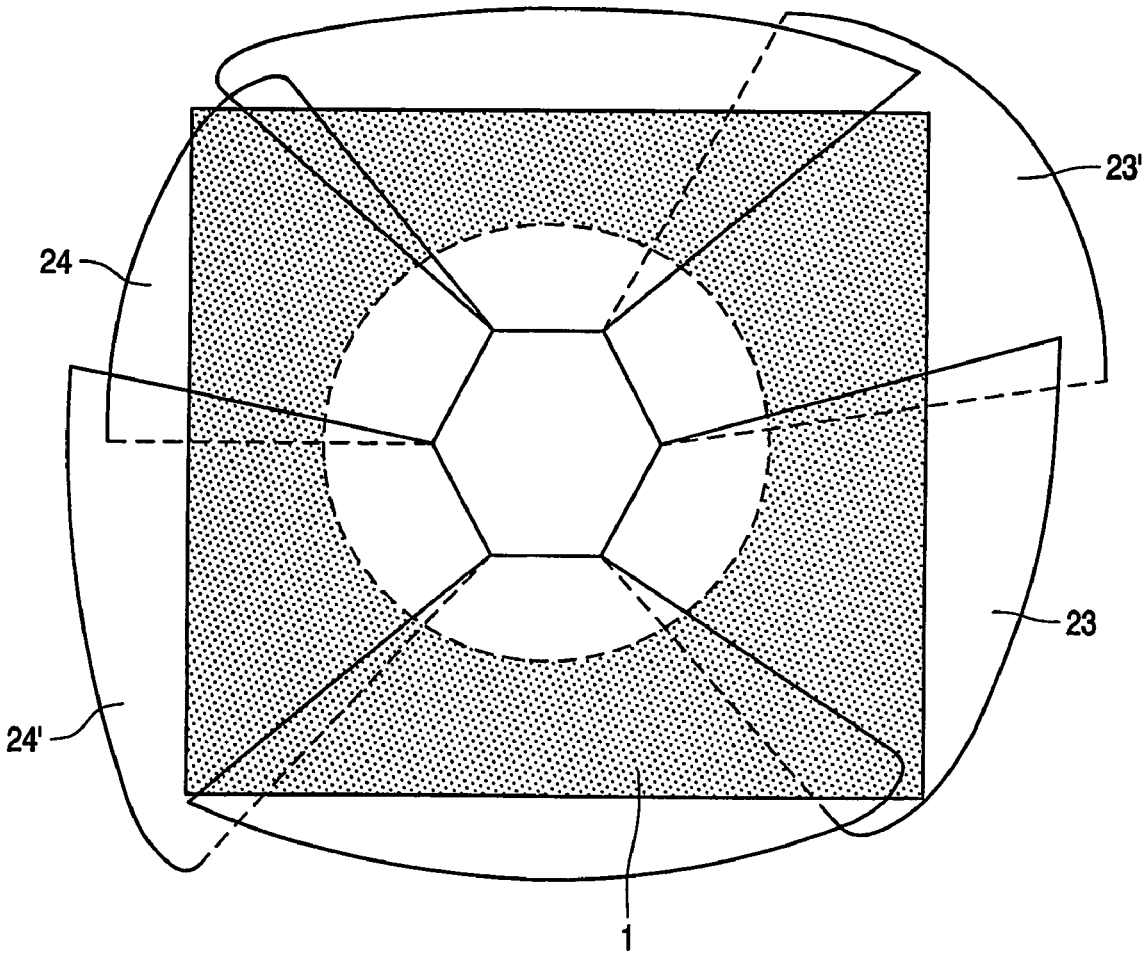
FIG. 3 is a top view of a diaphragm-like adjustable wedge-shaped structure.

FIG. 3 shows schematically a top view of a diaphragm-like adjustable wedge-shaped structure. In this embodiment, the wedge-shaped structure is configured from a plurality of walls 23, 23', . . . , 24, 24', . . . forming a diaphragm-like wedge-shaped structure with respect to the supporting member 1. The plurality of walls, comprising at least one first wall 23, 23', . . . and at least one second wall 24, 24', . . . function as (reflective) side flaps of the diaphragm-like wedge-shaped structure. The plurality of first and second walls 23, 23', . . . , 24, 24', . . . slide past each other when the wedge angle of the walls is changed.

FIG. 4 shows schematically a path of a light ray through a detail of the adjustable wedge collimator (the supporting member is not shown). A first wall 3 and a second wall 4' of an adjacent element are shown. The first wall 3 is provided with a specular reflecting surface 23 and the second wall 4' is provided with a specular reflecting surface 24'. In the example of FIG. 4 a light ray is incident on the open wedge (refractive index n=1) at an angle $\theta_i$ (with respect to the normal, parallel to $L_{in}$ in FIG. 1) and is reflected at the specular reflecting surface 23 on the first wall 3 that makes an angle $\theta_w$ (wedge angle) with the normal. In the example of FIG. 4 only one reflection takes place and the light ray issuing from the wedge collimator makes an angle $\theta_e$ with respect to the normal. The number of reflections depends on the incident angle $\theta_i$, the height $h_w$ of the elements, and the wedge angle $\theta_w$. The collimation angle $\theta_c$ with respect to the normal refers to the largest angle $\theta_e$ at which a light ray can emerge from the wedge structure when isotropic light with $0° \leqq \theta_i \leqq 90°$ with respect to the normal is incident upon the wedge-shaped structure.

In practice, the adjustability of the wedge angle $\theta_w$ is in the range from approximately 0° to approximately 25°, preferably $0 \leqq \theta_w \leqq 15°$. FIG. 4 shows a typical example of a view graph of the collimation angle $\theta_c$ as a function of the wedge angle $\theta_w$ for the adjustable wedge collimator. A collimation angle $\theta_c$ of approximately 46° is reached for a wedge angle $\theta_w$ of between approximately 11 and 22° (see the part of the curve in FIG. 4 denoted with (2) in which at maximum two reflections occur in the wedge-shaped structure). Higher values of the wedge angle are unattractive because this would lead to an aperture becoming too low. By lowering the wedge angle $\theta_w$, a collimation angle $\theta_c$ of approximately 50° is reached for a wedge angle $\theta_w$ of approximately 8° (see the part of the curve in FIG. 4 denoted with (3) in which at maximum three reflections occur in the wedge-shaped structure). By further lowering the wedge angle $\theta_w$, a collimation angle $\theta_c$ of approximately 55° is reached for a wedge angle $\theta_w$ of approximately 5° (see the part of the curve in FIG. 4 denoted with (4) in which at maximum four reflections occur in the wedge-shaped structure). By additionally lowering the wedge angle $\theta_w$, a collimation angle $\theta_c$ of approximately 60° is reached for a wedge angle $\theta_w$ of approximately 3° (see the part of the curve in FIG. 4 denoted with (5) in which at maximum five reflections occur in the wedge-shaped structure). By further lowering the wedge angle $\theta_w$, eventually, a collimation angle $\theta_c$ of 90° is reached for a wedge angle $\theta_w$ of 0° (see the part of the curve in FIG. 4 denoted with (6) in which the number of reflections rapidly increases).

The scope of protection of the invention is not limited to the embodiments given. The invention resides in each novel characteristic and each combination of characteristics. Reference numerals in the claims do not limit the scope of protection thereof The use of the verb "comprise" and its declinations does not exclude the presence of elements other than those specified in the claims. The use of the indefinite article "a" or "an" preceding an element does not exclude the presence of a plurality of such elements.

The invention claimed is:

1. A light-collimating system for collimating light from a light source, a plurality of elements, each element including at least a first wall and at least a second wall, the first wall of an element and the second wall of an adjacent element being spaced with respect to each other at a side of the light-collimating system facing the light source, said spacing between said first wall and said second wall defining an aperture window for admitting light from the light source into the light-collimating system, the first wall of said element and the second wall of said adjacent element forming a wedge-shaped structure widening in a direction facing away from the light source, the first wall and the second wall at a side facing the wedge-shaped structure being provided with a specular reflecting surface, the wedge angle $\theta_w$ of the first wall and the second wall with respect to the normal on the aperture window being adjustable for enabling adjustable collimation.

2. A light-collimating system as claimed in claim 1, characterized in that an adjustable positioning plate supports the first wall and the second wall at a side facing away from the wedge-shaped structure, by moving the positioning plate in a direction away from the aperture window the wedge angle $\theta_w$ becoming smaller, and vice versa.

3. A light-collimating system as claimed in claim 1, characterized in that the wedge angle $\theta_w$ ranges between approximately 0° and approximately 25°.

4. A light-collimating system as claimed in claim 3, characterized in that the wedge angle $\theta_w \leqq 15°$.

5. A light-collimating system as claimed in claim 1, characterized in that the wedge-shaped structure is configured from a plurality of walls forming a diaphragm-like wedge-shaped structure.

6. A light-collimating system as claimed in claim 1, characterized in that the first wall and the second wall are straight walls.

7. A light-collimating system as claimed in claim 1, characterized in that the first wall and the second wall are curved walls, preferably, are parabolically-shaped walls.

8. A light-collimating system as claimed in claim 1, characterized in that the first wall and the second wall of each element are provided on a supporting member at a side facing away from the light source, and that the supporting member between the first wall and the second wall of each element is provided with a light-reflecting element comprising a specular and/or diffuse reflecting material.

9. A light-collimating system as claimed in claim 8, characterized in that the specular reflecting material is selected from the group formed by silver and aluminum, and in that the diffuse reflecting material is selected from the group formed by aluminum oxide, barium sulfate, calcium-pyrophosphate, titanium oxide and yttrium borate.

10. A light-collimating system as claimed in claim 9, characterized in that the diffuse reflecting powder material is mixed with particles of Alon-C.

11. A light-collimating system as claimed in claim 1, characterized in that the first wall and the second wall are made from glass, metal or plastic.

12. A light-collimating system as claimed in claim 1, characterized in that, at the location of the first and second wall facing the light source, the distance $d_{sp}$ between the first wall and the second wall of each element is larger than the wavelength of visible light.

13. A light-collimating system as claimed in claim 12, characterized in that the distance $d_{sp} \geqq 10$ μm.

14. A light-collimating system as claimed in claim 12, characterized in that the height $h_w$ of the wedge-shaped structures is in the range $0.5 \times d_{aw} \leqq h_w 50 \times d_{aw}$, where $d_{aw}$ is the distance between the first wall of an element and the second wall of an adjacent element at the location of the first and second wall facing the light source.

15. A light-collimating system as claimed in claim 1, characterized in that the light-collimating system further comprises a lens assembly, comprising a plurality of lenses, each lens cooperating with one of the wedge-shaped structures.

* * * * *